US006289908B1

(12) United States Patent
Kelsey

(10) Patent No.: US 6,289,908 B1
(45) Date of Patent: Sep. 18, 2001

(54) DOUBLE DISHWASHER

(76) Inventor: Marjorie K. Kelsey, P.O. Box 115, Arden, On (CA), K0H 1B0

( * ) Notice: Subject to any disclaimer, the term of this patent is extended or adjusted under 35 U.S.C. 154(b) by 0 days.

(21) Appl. No.: 09/451,716

(22) Filed: Dec. 1, 1999

(51) Int. Cl.[7] ..... A47L 15/42

(52) U.S. Cl. ..... 134/200; 134/88; 312/228; 312/324

(58) Field of Search ..... 134/115 R, 84–91, 134/56 D, 57 D, 58 D, 176, 179, 200; 312/228, 228.1, 324

(56) References Cited

U.S. PATENT DOCUMENTS

| | | | | |
|---|---|---|---|---|
| D. 440,320 | | 10/1998 | Brace | D32/2 |
| 635,009 | * | 10/1899 | Atkinson | 134/86 X |
| 2,106,619 | * | 1/1938 | Merrill | 134/200 X |
| 2,675,012 | * | 4/1954 | Scales | 134/91 X |
| 3,288,154 | * | 11/1966 | Jacobs | 134/200 X |
| 3,620,234 | * | 11/1971 | Everroad | 134/88 X |
| 3,645,791 | * | 2/1972 | Sadwith | 134/176 X |
| 3,724,636 | | 4/1973 | Wright | 198/19 |
| 4,088,145 | | 5/1978 | Noren | 134/104 |
| 4,134,413 | | 1/1979 | Noren | 134/47 |
| 4,357,176 | | 11/1982 | Anthony | 134/18 |
| 4,608,780 | * | 9/1986 | Van Noy | 134/200 X |
| 4,739,781 | | 4/1988 | Casoli | 134/115 R |
| 5,755,244 | | 5/1998 | Sargeant | 134/46 |
| 5,806,541 | * | 9/1998 | Cooper et al. | 134/55 D X |
| 5,934,298 | | 8/1999 | Singh | 134/85 |

FOREIGN PATENT DOCUMENTS

| | | | | |
|---|---|---|---|---|
| 691286 | * | 7/1965 | (IT) | 1134/115 R |

OTHER PUBLICATIONS

President's Choice Magazine, Sep. 1999, pp. 22–24.

* cited by examiner

*Primary Examiner*—Philip R. Coe
(74) *Attorney, Agent, or Firm*—Richard J. Hicks

(57) ABSTRACT

A double, front loading, dishwasher comprising two side-by-side dishwashing cabinets each provided with a washing arm and either a common pump and motor or an individual pump and motor is described. Preferably, the dishwasher is designed to fit into an existing kitchen cabinet and even more preferably into an eye level kitchen cabinet so that while one cabinet is used to store clean dishes and cutlery the other cabinet is available to load and wash another set of dirty dishes. Storage of a set of clean dishes in the dishwasher saves time as the step of unloading the dishwasher to a separate storage cabinet is eliminated, as the clean dishes may be unloaded directly to the table.

6 Claims, 5 Drawing Sheets

DOUBLE DISHWASHER

FIELD OF INVENTION

This invention relates to automatic dishwashers, and more particularly to a double dishwasher combination which can also be used to store washed dishes and cutlery.

BACKGROUND OF INVENTION AND PRIOR ART

Automatic dishwashers are, of course, well known in the art and generally comprise a single cabinet into which dirty dishes and cutlery can be loaded for washing, usually through a front door hinged along the lower edge thereof. Double dishwashers are also known in the art in which two cabinets are employed so that it si possible to wash half a load or to separate, for example, pots and pans from glasses. Attention is directed to U.S. Pat. Des. No. 400,320 issued Oct. 27, 1998 assigned to Fisher & Paykel Limited, who market the product under the tradename "DishDrawer", which describes a drawer type dishwasher with two drawers mounted vertically one above the other but using a single drive motor and pump. Attention is also directed to U.S. Pat. 5,934,298 issued August 10, 1999 to Singh which describes a combination sink and dishwashing apparatus in which the sink shares a common side wall with each of the two dishwashing cabinets. Each common side wall can be opened to allow a wire basket contained in the cabinet to slide out into the sink to facilitate loading or unloading thereof. A single drive motor may be used to drive the pumps in each dishwasher cabinet and a garbage disposal located in the sink drain. Such units are relatively cumbersome, can only accomodate a single basket or rack and hence have only a very limited capacity which is governed by the size of the sink into which the basket moves, and take up a great deal of kitchen space and they are generally relatively expensive relative to a standard domestic dishwasher. They are also designed as floor level units. Dishwashing units designed to fit into kitchen furniture units are also known, and attention is drawn to U.S. Pat. 4,739,781, which describes a compact, top loading, single unit dishwasher suitable for fitting inside a furniture unit or the like. It will be readily appreciated that top loading dishwashers are relatively difficult to load and unload and have the further disadvantage that they must be removed from their containing unit for access. There is a need, therefore, for an improved double dishwasher which can be used like the "DishDrawer" described above, to either separate types of load, use a half load, or to store dishes in one side while washing in the other side. Such dishwashing units should be front opening and to facilitate use as a storage cupboard should have front opening doors, hinged along one side edge thereof. Preferably, such units should be dimensioned to fit inside existing kitchen cabinets and even more preferably such units should be at eye-level.

OBJECT OF INVENTION

It is an object of the the present invention to provide a double dishwasher unit, which can be fitted into a kitchen cabinet, preferably an eye level cabinet so that one half of the unit can be used to store clean crockery and utensils while the other half is used to store and/or wash a load of dirty dishes and utensils. Preferably, both units are powered by a single pump and motor unit in order to minimize weight and expense.

BRIEF DESCRIPTION OF INVENTION

By one aspect of this invention there is provided a dishwashing apparatus comprising:

a pair of front opening dishwashing cabinets in side-by side relationship and having a common side wall therebetween, each defining a closed space therewithin and provided with dish supporting means for supporting a plurality of dishes therein, means for spraying said dishes so as to clean the dishes, means to supply water to said means for spraying, and means to drain water from said cabinet; and wherein each said cabinet is provided with a door means pivotally mounted about a vertical axis to an opposed side wall of each said cabinet, and each said door has a resilient sealing means therearound so as to provide a watertight seal around said closed space.

DETAILED DESCRIPTION OF PREFERRED EMBODIMENTS

Figure 1:
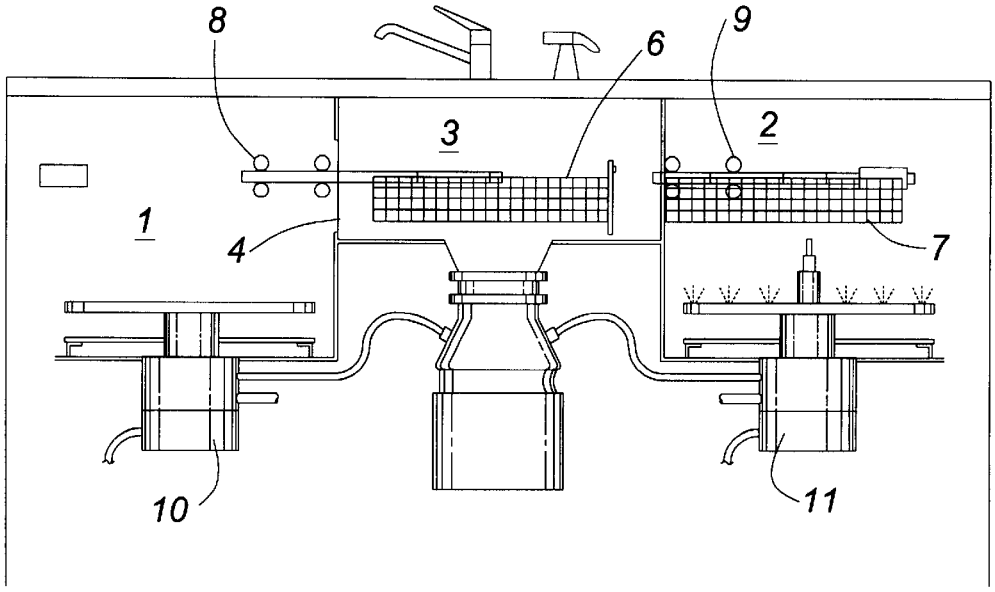
PRIOR ART FIG. 1
FIG. 1 is a front elevational view of a double dishwasher according to the prior art (U.S. Pat. No. 5,934,298)
Figure 2:
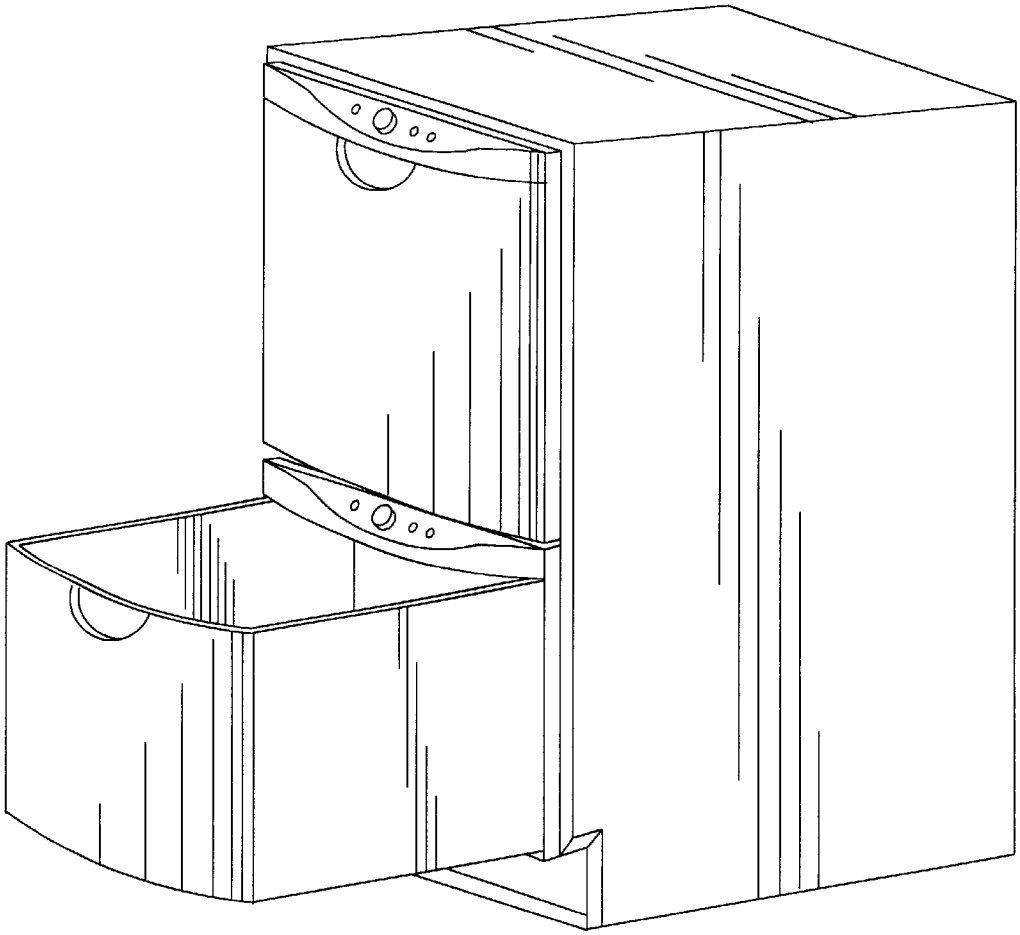
PRIOR ART FIG. 2
FIG. 2 is an isometric view of a double dishwasher according to the prior art (U.S. Des. Pat No. 400,320)
Figure 3:
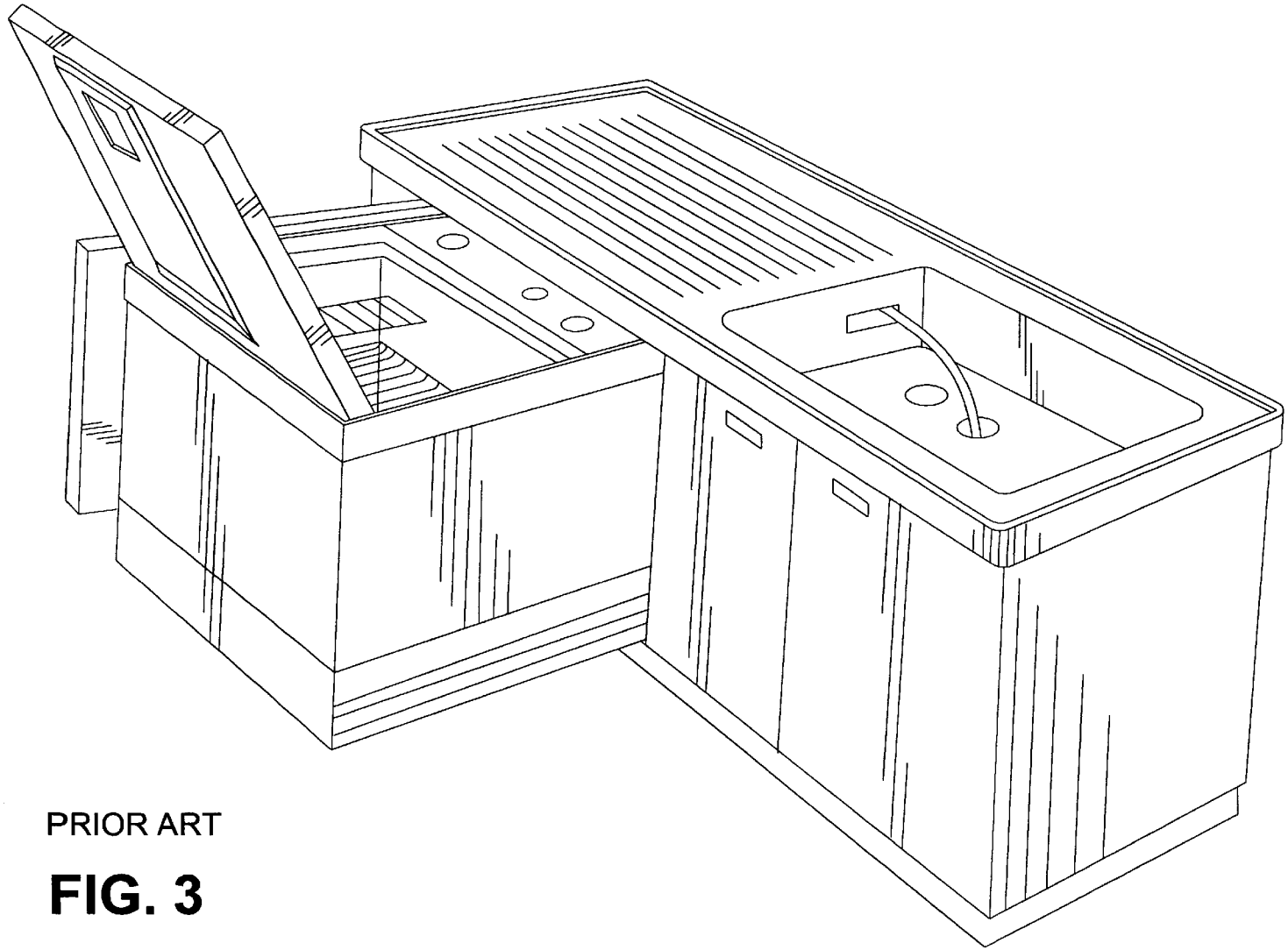
PRIOR ART FIG. 3
FIG. 3 is an isometric view of a a dishwasher according to the prior art (U.S. Pat. No. 4,739,781)

Briefly, FIG. 1 shows a side by side double dishwasher of the prior art in which the two washer cabinets 1,2 open into a central sink 3 via doors 4,5. Wire racks 6,7 can be moved alternately, on rollers 8,9, into sink 3 but sink 3 is not sufficiently large to accomodate both racks at the same time. In this embodiment, each of cabinets 1,2 is provided with its own pump and motor 10,11 and sink 3 is provided with a garbage disposal 12. in other embodiments motors 10, 11 and 12 may be combined into a single motor. FIG. 2 shows a drawer type, top loading, double dishwasher unit of the prior art as described hereinabove. FIG. 3 shows a top loading, single unit, dishwasher of the prior art which is designed to fit into standard kitchen furniture units also as described hereinabove.

Figure 4:
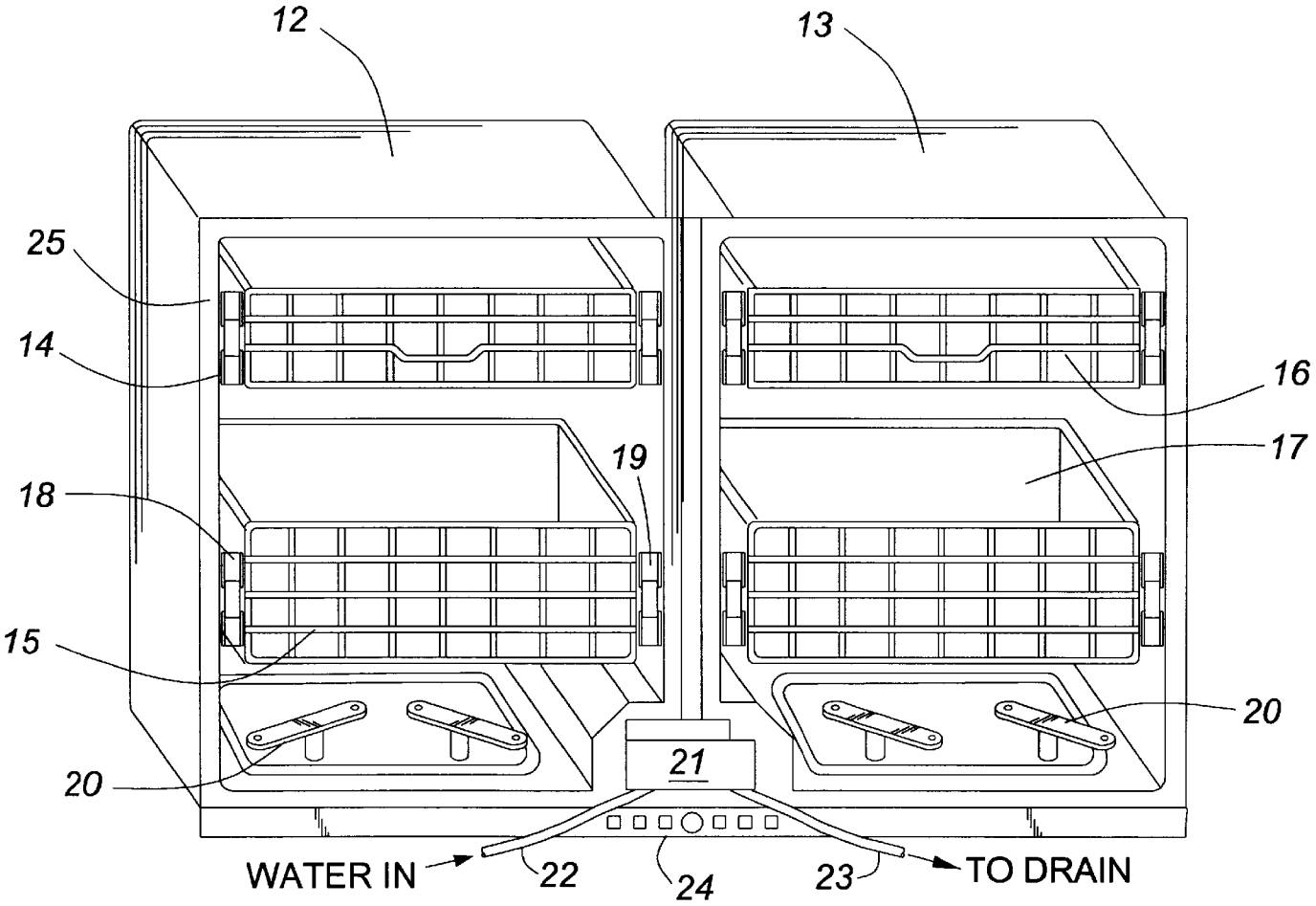
FIG. 4 is a front view of a double dishwasher according to one embodiment of the present invention, with the outer doors removed.
Figure 5:
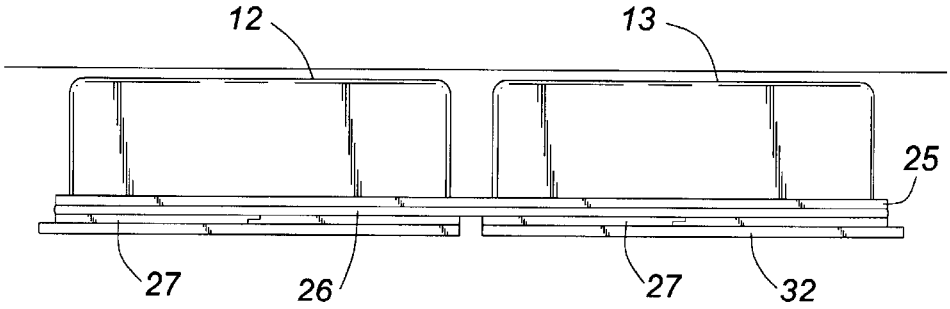
FIG. 5 is a top plan view of the embodiment of FIG. 4.
Figure 6:
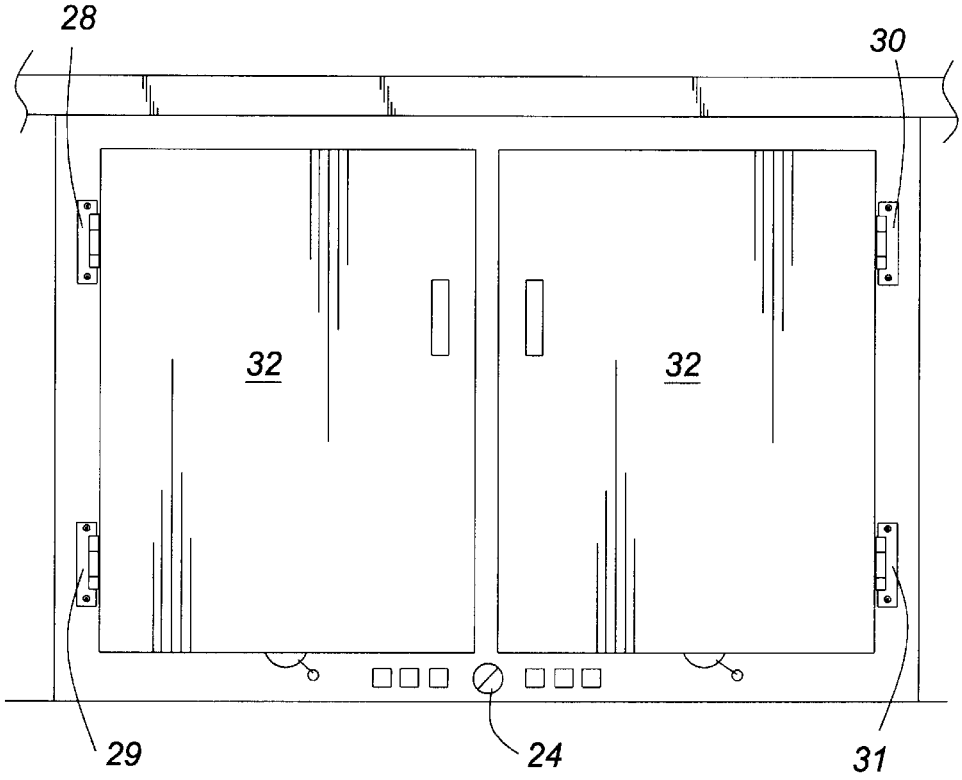
FIG. 6 is a front view of the embodiment of FIG. 4 with the outer doors in closed position.

Turning now to FIG. 4, which shows a front view of a double dishwasher according to the present invention, there are provided two dishwasher cabinets 12, 13 in side by side relationship with a common sidewall. Cabinets 12, 13 are relatively shallow to facilitate easy installation in a kitchen cabinet, preferably but not essentially at eye level. The present invention also contemplates use of floor level double dishwashers. Typically, but not essentially, cabinets 12, 13 are about 60"–72" wide (total), about 12" deep and about 32" high. Each cabinet 12, 13 is provided with at least one wire dishwasher rack 14, 15, 16, 17 each of which rolls on a pair of conventional roller tracks 18, 19; at least one rotary washer nozzle 20 is also provided in each cabinet, either connected to its own pump and motor or to a single, shared, pump and motor 21, which in turn is provided with a water supply 22 and drain 23, and a control panel 24. The front 25 of the two cabinets 12, 13 is provided with a rubber seal 26 (as seen in FIG. 5) which sealingly engage washer doors 27, hingedly mounted on cabinets 12, 13 by hinges 28, 29, 30, 31. Each washer door 27 is faced with a standard kitchen cabinet door 32 to match the existing kitchen decor, as seen in FIG. 6.

In use, either cabinet 12, 13 can be filled with used cutlery and crockery and put through a wash/dry cycle in conventional manner. When the dry cycle is complete, however, it is not necessary to unload the cabinet immediately. The clean cutlery and crockery can be stored in the cabinet until needed for use and then unloaded directly to the table or other point of use. In the meantime, additional dirty dishes etc can be loaded into the other, unused cabinet for washing at any convenient time, and similarly stored for use. This arrangement saves considerable time and extra storage space for clean dishes etc as the two cabinets 12, 13 can be used interchangeably and independently at any time for clean/dirty storage and/or washing.

I claim:

1. A dishwashing apparatus comprising:

a pair of front opening dishwashing cabinets in side-by side relationship and having a common side wall therebetween, each defining a closed space therewithin and provided with dish supporting means for supporting a plurality of dishes therein, means for spraying said dishes so as to clean the dishes, means to supply water to said means for spraying, and means to drain water from said cabinet; and wherein each said cabinet is provided with a door means pivotally mounted about a vertical axis to an opposed side wall of each said cabinet, and each said door has a resilient sealing means therearound so as to provide a watertight seal around said closed space.

2. A dishwashing apparatus as claimed in claim 1 wherein each said door means is provided with a planar decorative cover means in overlying relationship thereto.

3. A dishwashing apparatus as claimed in claim 1 wherein said means to supply water includes powered pump means in each said cabinet.

4. A dishwashing apparatus as claimed in claim 1 wherein said means to supply water includes a common powered pump means intermediate said cabinets.

5. A dishwashing apparatus as claimed in claim 1 arranged for installation inside a kitchen cabinet.

6. A dishwashing apparatus as claimed in claim 5 wherein said kitchen cabinet is an eye level cabinet.

* * * * *